US005305691A

United States Patent [19]

Maeijima

[11] Patent Number: 5,305,691

[45] Date of Patent: Apr. 26, 1994

[54] PLATE LOCKUP DEVICE POSITION DETECTING APPARATUS FOR PRINTING PRESS

[75] Inventor: Kazuhiro Maeijima, Ibaragi, Japan

[73] Assignee: Komori Corporation, Japan

[21] Appl. No.: 14,274

[22] Filed: Feb. 5, 1993

[30] Foreign Application Priority Data

Feb. 10, 1992 [JP] Japan ..... 4-13053

[51] Int. Cl.[5] ..... B41F 1/28

[52] U.S. Cl. ..... 101/415.1; 101/481; 101/486

[58] Field of Search ..... 101/378, 383, 384, 415.1, 101/481, 485, 486, 408, 409; 33/614, 617, 619, 620, 621

[56] References Cited

U.S. PATENT DOCUMENTS 4,437,407 3/1984 Wirz et al. ..... 101/409
5,168,805 12/1992 Kasanami et al. ..... 101/486 X

FOREIGN PATENT DOCUMENTS 3000576 7/1981 Fed. Rep. of Germany ... 101/415.1
0065661 4/1983 Japan ..... 101/415.1
0293856 12/1986 Japan ..... 101/415.1
0023754 1/1987 Japan ..... 101/415.1
0118255 5/1988 Japan ..... 101/415.1
1-42135 3/1989 Japan .
0176150 7/1991 Japan ..... 101/415.1

*Primary Examiner*—Edgar S. Burr
*Assistant Examiner*—Christopher A. Bennett
*Attorney, Agent, or Firm*—Blakely, Sokoloff, Taylor & Zafman

[57] ABSTRACT

A plate lockup device position detecting apparatus for a printing press includes first and second limit switches, and a series circuit. The first limit switch is provided in a gap of a plate cylinder and detects that a leading-side plate lockup device, a position of which is adjustable at least in one of vertical and horizontal directions of a plate, is restored to its origin position. The second limit switch is provided in the gap and detects that a trailing-side plate lockup device, a position of which is adjustable at least in one of the vertical and horizontal directions of the plate, is restored to its origin position. The series circuit detects that the plate lockup devices are restored to their origin positions from a logical product of the detection outputs from the first and second limit switches.

10 Claims, 3 Drawing Sheets

PLATE LOCKUP DEVICE POSITION DETECTING APPARATUS FOR PRINTING PRESS

BACKGROUND OF THE INVENTION

The present invention relates to a plate lockup device position detecting apparatus for a printing press, e.g., a sheet printing press, which detects whether or not plate lockup devices are restored to their origin positions.

Conventionally, in a printing press, e.g., a sheet printing press, the leading and trailing ends of a plate are set in leading- and trailing-side plate lockup devices provided to a plate cylinder, and the plate cylinder is moved by using a plate registration remote controller, thereby adjusting plate registration. For example, a plate registering device, as disclosed in Japanese Utility Model Laid-Open No. 64-42135, having motors and screw mechanisms in the horizontal and vertical directions of a plate is operated by remote control using a plate registration remote controller, thereby adjusting the position of the plate set in the plate lockup devices.

In this adjustment, when, e.g., the position of the plate cannot be sufficiently adjusted with the adjustment width of the plate registration remote controller, the plate lockup devices are sometimes manually moved in the horizontal or vertical direction of the plate. When the plate lockup devices are moved in this manner, both the leading- and trailing-side plate lockup devices must be manually restored to their origin positions before the plate is exchanged for a new one. Especially, when an automatic plate exchange apparatus enabling automatic plate exchange is used, if the operator forgets to restore the plate lockup devices to their origin positions, exchange and registration errors may be caused.

Conventionally, however, no means is available for detecting whether or not the plate lockup devices are restored to the origin positions, and if the plate lockup devices are forgotten to be restored to their origin positions, troubles as described above sometimes occur.

SUMMARY OF THE INVENTION

It is an object of the present invention to provide a plate lockup device position detecting apparatus for a printing press, which automatically detects whether or not plate lockup devices are restored to their origin positions.

It is another object of the present invention to provide a plate lockup device position detecting apparatus for a printing press, which prevents the plate exchange and registration errors.

According to the present invention, there is provided a plate lockup device position detecting apparatus for a printing press, comprising first origin position detecting means, provided in a gap of a plate cylinder, for detecting that a leading-side plate lockup device, a position of which is adjustable at least in one of vertical and horizontal directions of a plate, is restored to an origin position thereof, second origin position detecting means, provided in the gap, for detecting that a trailing-side plate lockup device, a position of which is adjustable at least in one of the vertical and horizontal directions of the plate, is restored to an origin position thereof, and informing means for detecting that the plate lockup devices are restored to the origin positions thereof from a logical product of detection outputs from the first and second origin position detecting means.

DESCRIPTION OF THE PREFERRED EMBODIMENT

The preferred embodiment of a plate lockup device position detecting apparatus according to the present invention will be described in detail with reference to the accompanying drawings.

Figure 1:
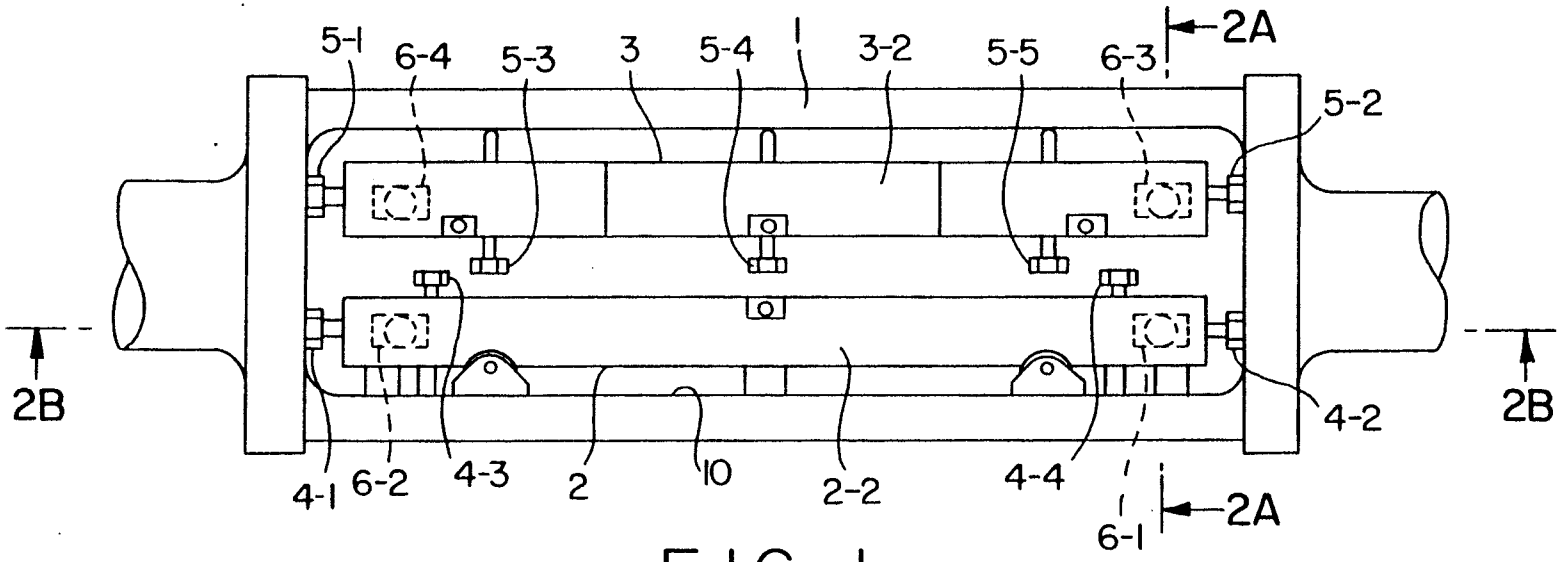
FIG. 1 is a plan view showing a plate cylinder to which a plate lockup device position detecting apparatus according to an embodiment of the present invention is applied.
Figure 2A:
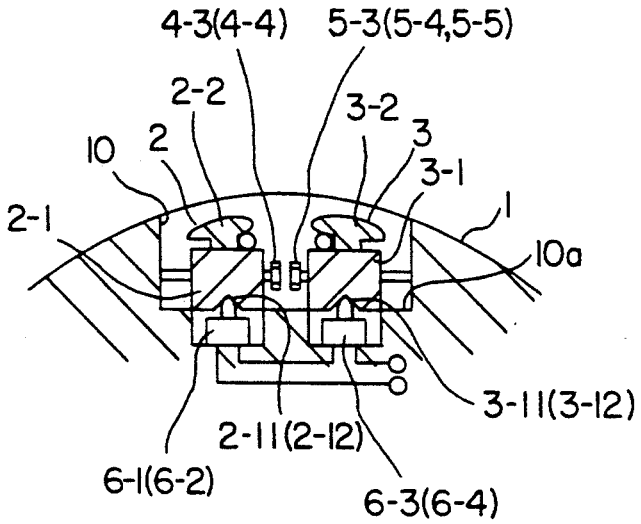
FIG. 2A is a sectional view taken along the line A—A of FIG. 1.
Figure 2B:
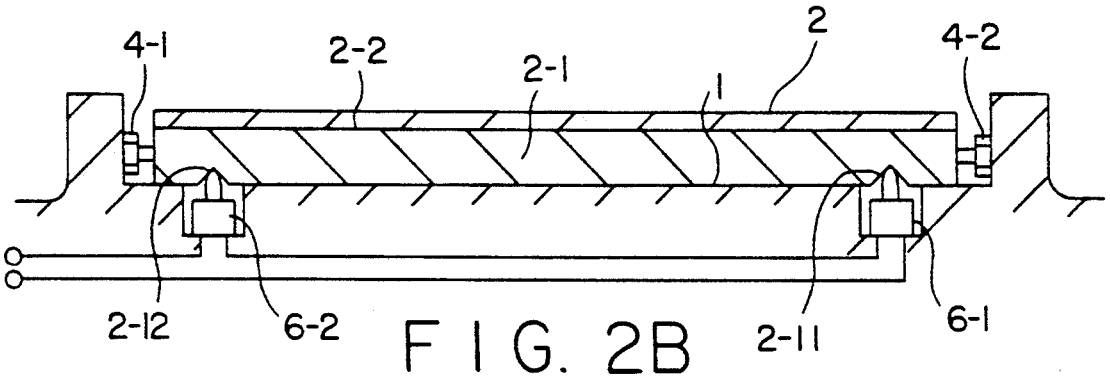
FIG. 2B is a sectional view taken along the line B—B of FIG. 1.

FIG. 1 shows a plate cylinder to which a plate lockup device position detecting apparatus according to an embodiment of the present invention is applied, FIG. 2A shows the apparatus along the line A—A of FIG. 1, and FIG. 2B shows the apparatus along the line B —B of FIG. 1.

Referring to FIGS. 1 to 2B, reference numeral 1 denotes a plate cylinder on which a plate is to be wound; 2, a leading-side plate lockup device, provided in a gap 10 formed in the plate cylinder 1 in the axial direction, for gripping the leading end of the plate; 3, a trailing-side plate lockup device, provided in the gap 10, for gripping the trailing end of the plate; 4-1 and 4-2, horizontal direction adjusting bolts for adjusting the position of the leading side of the plate in the horizontal direction by adjusting the position of the leading-side plate lockup device 2 in the axial direction of the plate cylinder 1; 4-3 and 4-4, vertical direction adjusting bolts for adjusting the position of the leading side of the plate in the vertical direction by adjusting the position of the leading-side plate lockup device 2 in the circumferential direction of the plate cylinder 1; 5-1 and 5-2, horizontal direction adjusting bolts for adjusting the position of the trailing side of the plate in the horizontal direction by adjusting the position of the trailing-side plate lockup device 3 in the axial direction of the plate cylinder 1; and 5-3 to 5-5, vertical direction adjusting bolts for adjusting the position of the trailing side of the plate in the vertical direction by adjusting the position of the trailing-side plate lockup device 3 in the circumferential direction of the trailing-side plate lockup device 3. As can be seen in FIGS. 1, 2A and 2B, the leading-side plate lockup device 2 includes base 2-1 extended in the axial direction of the plate cylinder 1 and gripper plate 2-2 for gripping the leading end of the plate in conjunction with the base 2-1. Further, the trailing-side plate lockup device 3 includes base 3-1 extended in the axial direction of the plate cylinder 1 and gripper plate 3-2 for gripping the trailing end of the plate in conjunction with the base 3-1. The gripper plate 3-2 is divided into 3 portions in the axial direction of the plate cylinder 1.

Two ball plunger type limit switches 6 (6-1 and 6-2) are stationarily incorporated in separate portions of a bottom portion 10*a* of the gap 10 contacting the lower portion of a base 2-1 of the leading-side plate lockup device 2 in the axial direction of the plate cylinder 1, such that actuator portions 6*a* of the limit switches 6 oppose the base 2-1. Similarly, two ball plunger type limit switches 6 (6-3 and 6-4) are stationarily incorporated in other separate portions of the bottom portion 10*a* of the gap 10 contacting the lower portion of a base 3-1 of the trailing-side plate lockup device 3 in the axial direction of the plate cylinder 1.

Figure 3:
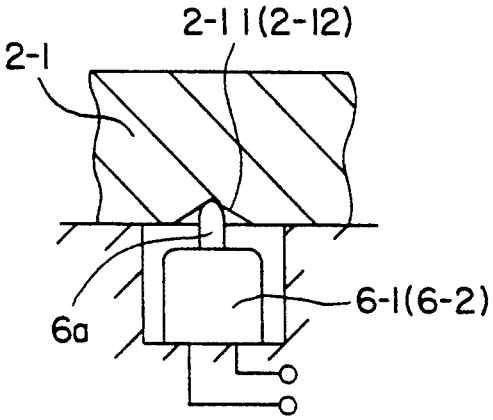
FIG. 3 is a view showing the relationship between the counter sinking portion of a plate lockup device and the actuator portion of a limit switch.

The limit switches 6-1 and 6-2 are turned on when the moving position of the leading-side plate lockup device 2 is set at its origin position both in the axial and circumferential directions of the plate cylinder 1 shown in FIGS. 2A and 2B. More specifically, counter sinking portions 2-11 and 2-12 are formed in the bottom portion of the base 2-1 of the leading-side plate lockup device 2 to oppose the actuator portions 6*a* of the limit switches 6-1 and 6-2. As shown in FIG. 3, when the actuator portions 6*a* project into the counter sinking portions 2-11 and 2-12, the limit switches 6-1 and 6-2 are turned on.

Similarly, the limit switches 6-3 and 6-4 are turned on when the moving position of the trailing-side plate lockup device 3 is set at its origin position both in the axial and circumferential directions of the plate cylinder 1 shown in FIGS. 2A and 2B. More specifically, counter sinking portions 3-11 and 3-12 are formed in the bottom portion of the base 3-1 of the trailing-side plate lockup device 3 to oppose the actuator portions 6*a* of the limit switches 6-3 and 6-4. When the actuator portions 6*a* project into the counter sinking portions 3-11 and 3-12, in the same manner as described above, the limit switches 6-3 and 6-4 are turned on.

Figure 4:
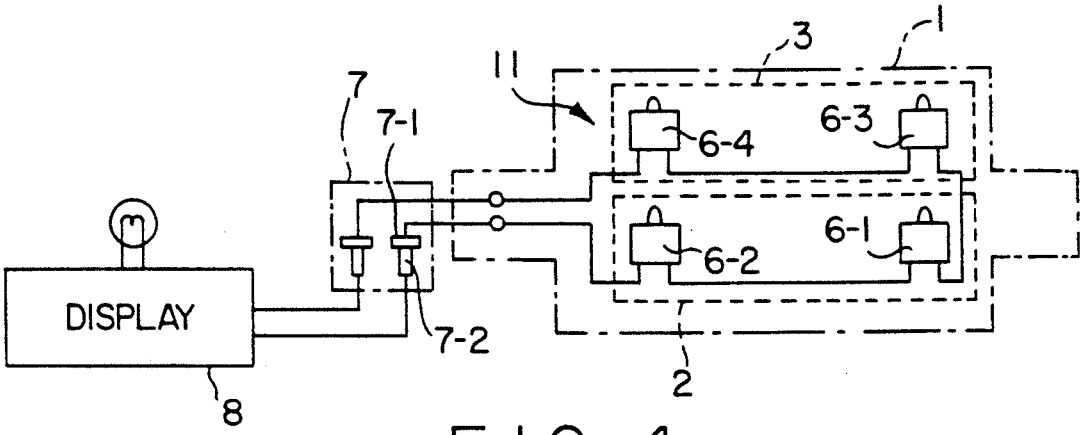
FIG. 4 is an electric circuit diagram of the plate lockup device position detecting apparatus according to the present invention.

FIG. 4 shows the electric circuit of this plate lockup device position detecting apparatus. In the plate cylinder 1, the limit switches 6-1 and 6-2 arranged in the leading-side plate lockup device 2 and the limit switches 6-3 and 6-4 arranged in on the trailing-side plate lockup device 3 are connected in series to constitute a series circuit 11, and this series circuit 11 is connected to a display 8 outside the plate cylinder 1 through the contacts (a contact type contact structure) of a signal transmitting means 7.

In the plate lockup device position detecting apparatus having the structure as described above, when both the leading- and trailing-side plate lockup devices 2 and 3 are at their origin positions, i.e., when the plate lockup devices are at their origin positions, the actuator portions 6*a* are engaged with and project into the corresponding counter sinking portions 2-11, 2-12, 3-11, and 3-12 of the bases 2-1 and 3-1 to turn on all the limit switches 6-1 to 6-4. Thus, a loop circuit constituted by the series circuit 11 is formed through the signal transmitting means 7, and the display 8 is turned on directly by a current flowing through this loop circuit, or by a drive circuit (not shown) receiving a loop closing signal.

However, assume that at least one of the leading- and trailing-side plate lockup devices 2 and 3 is left at its adjusted position. For example, assume that the position of the leading-side plate lockup device 2 is adjusted by the horizontal direction adjusting bolts 4-1 and 4-2 or vertical direction adjusting bolts 4-2 and 4-3 in the plate mounting operation of the last printing operation, and the plate lockup device 2 is not restored to its origin position. In this case, the actuator portions 6*a* of the limit switches 6-1 and 6-2 are removed from the counter sinking portions 2-11 and 2-12, are depressed by the bottom surface of the base 2-1 sliding on the bottom portion 10*a* of the gap 10, and are thus turned off. Accordingly, the loop of the series circuit 11 constituted by the limit switches 6-1 to 6-4 is open, and the display 8 is kept off accordingly.

More specifically, in this embodiment, the display 8 is turned on only when both the leading- and trailing-side plate lockup devices 2 and 3 are set at their origin positions, that is, only when the plate lockup devices are restored to their origin positions. Therefore, if the plate lockup devices are not restored to their origin positions, this fact can be obtained from the OFF state of the display 8. Hence, when the plate is to be exchanged for a new one, the plate lockup devices can be prevented from being forgotten to be restored to their origin positions.

In this embodiment, two limit switches are provided to each of the leading- and trailing-side plate lockup devices 2 and 3. However, the number of limit switches to be provided to each plate lockup device can be one, or can be three or more.

Restoration of the leading- and trailing-side plate lockup devices 2 and 3 to their origin positions is not limitedly detected by limit switches, but can be detected by using position detection sensors, e.g., potentiometers.

Figure 5:
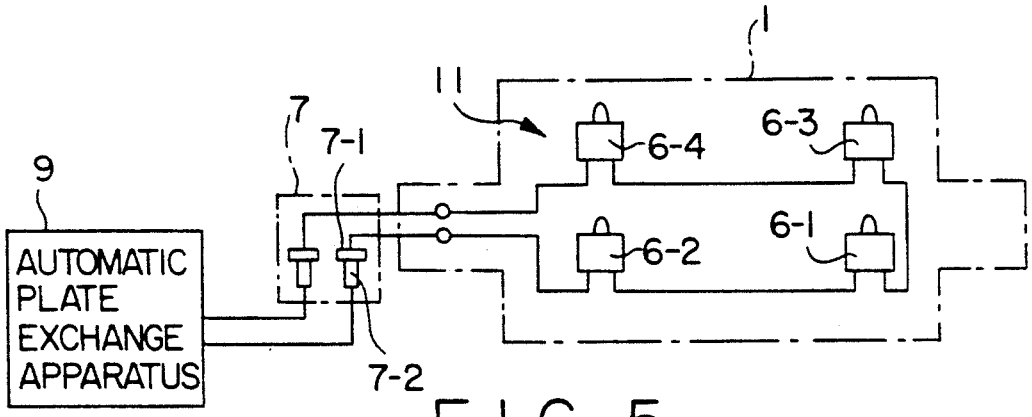
FIG. 5 is an electric circuit diagram of the plate lockup position detecting apparatus according to the present invention combined with an automatic plate exchange apparatus.

In this embodiment, the state wherein the plate lockup devices are restored to their origin positions is informed to the display 8. However, this state can also be informed to an automatic plate exchange apparatus 9, as shown in FIG. 5. If the automatic plate exchange apparatus operates on condition that the plate lockup devices are restored to their origin positions, troubles during automatic plate exchange can be automatically prevented.

In this embodiment, the signal transmitting means 7 has a contact type contact structure. However, it can have a non-contact type contact structure (it can have no contacts), like a proximity switch.

Figure 6:
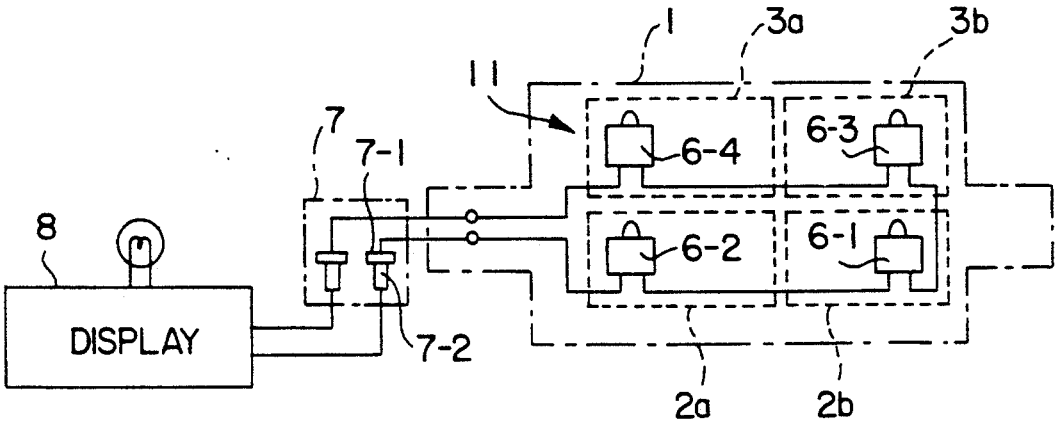
FIG. 6 is an electric circuit diagram of the plate lockup device position detecting apparatus according to the present invention applied to a plate cylinder having divided block type plate lockup devices.

Furthermore, in this embodiment, each of the leading- and trailing-side plate lockup devices 2 and 3 is made of an integral structure extending in the axial direction of the plate cylinder 1. However, it can be divided into a plurality of pieces in the axial direction of the plate cylinder 1. For example, as shown in FIG. 6, assume that the leading-side plate lockup device 2 may comprise divided blocks 2*a* and 2*b* each having a moving position adjusting means, and that the trailing-side plate lockup device 3 may comprise divided blocks 3*a* and 3*b* each having a moving position adjusting means. In this case, the origin position detecting means for detecting the origin positions of the divided blocks 2*a*, 2*b*, 3*a*, and 3*b* in the axial and circumferential directions of a plate cylinder 1 may be provided such that it is constituted by the series-connected limit switches 6-1 to 6-4 in correspondence with the divided blocks 2*a* and 2*b* of the leading-side plate lockup device 2 and the divided blocks 3*a* and 3*b* of the trailing-side plate lockup device 3. In this case, the number of divided blocks of each plate lockup device is not limited to two, but can be three or more.

As has been described above, according to the present invention, it is possible to know whether or not both the leading- and trailing-side plate lockup devices are restored to their origin positions, i.e., whether or not the plate lockup devices are restored to their origin positions. Therefore, when the plate is to be exchanged for a new one, the plate lockup devices can be prevented from being forgotten to be restored to their origin positions. Also, if the restored state of the plate lockup devices to their origin positions is informed to the automatic plate exchange apparatus, it is possible to automatically prevent troubles during automatic plate exchange by setting the automatic plate exchange apparatus to operate on the condition that the plate lockup devices are restored to their origin positions.

What is claimed is:

1. A plate lockup device position detecting apparatus for a printing press, comprising:

a plate cylinder having a circumferential surface on which a plate is mounted;

a gap formed in the circumferential surface of said plate cylinder in an axial direction thereof and having a bottom portion;

a leading-side plate lockup device provided in said gap and having a first recess formed on a bottom side thereof, the leading-side plate lockup device being slidable on the bottom portion of the gap;

a trailing-side plate lockup device provided in parallel with said leading-side plate lockup device in said gap and having a second recess formed on a bottom side thereof, the trailing-side plate lockup device being slidable on the bottom portion of the gap;

a first origin position detecting switch with a first actuating member, fixed on the bottom portion of said gap, for detecting that said leading-side plate lockup device, a position of which is adjustable at least in one of vertical and horizontal directions of the plate, is restored to a first origin thereof, said first actuating member capable of being engaged with the first recess of said leading-side plate lockup device when the leading-side plate lockup device is located at the first origin position thereof;

a second origin position detecting switch with a second actuating member, fixed on the bottom portion of said gap, for detecting that said trailing-side plate lockup device, a position of which is adjustable at least in one of vertical and horizontal directions of the plate, is restored to a second origin position thereof, said second actuating member capable of being engaged with the second recess of said trailing-side plate lockup device when the trailing-side plate lockup device is located at the second origin position thereof; and informing means for informing that said leading- and trailing-side plate lockup devices are respectively restored to the first and second origin positions on the basis of detection outputs from said first and second origin position detecting switches.

2. An apparatus according to claim 1, wherein said first and second origin position detecting means respectively comprise switches which are closed when said leading- and trailing-side plate lockup devices are restored to the origin positions thereof, and said informing means comprises a series circuit of said switches.

3. An apparatus according to claim 1, wherein said informing means outputs an informing signal indicating restoration of said leading- and trailing-side lockup devices to the first and second origin positions, and further comprising display means, driven by the informing signal from said informing means, for displaying that said plate lockup devices are at the first and second origin positions.

4. An apparatus according to claim 1, wherein said informing means outputs an informing signal indicating restoration of said leading- and trailing-side lockup devices to the first and second origin positions, and further comprising automatic plate exchange means for automatically exchanging a plate on a condition that the informing signal is input thereto from said informing means.

5. An apparatus according to claim 1, wherein each of said first and second origin position detecting means comprises a plurality of origin position detecting means, and said informing means outputs an informing signal by obtaining a logical product of detection outputs from all of said origin position detecting means.

6. An apparatus according to claim 5, wherein each of said leading- and trailing-side plate lockup devices comprises a plurality of divided blocks and one of said first and second origin position detecting means corresponds to each of said divided blocks.

7. An apparatus according to claim 1, further comprising signal transmitting means for outputting an output from said informing means to the outside of the rotatable plate cylinder.

8. An apparatus according to claim 1, wherein said leading- and trailing-side plate lockup apparatus include bases to slide on said bottom surface of the gap, and the first and second recesses are respectively formed on bottoms of said bases.

9. An apparatus according to claim 1, wherein said informing means informs restoration of said leading- and trailing-side lockup devices to the first and second origin positions by obtaining a logical product of detection outputs from said first and second origin position detecting switches.

10. A plate lockup device position detecting apparatus for a printing press, comprising:

a plate cylinder for mounting a plate on a circumferential surface thereof;

a gap formed in the circumferential surface of said plate cylinder in an axial direction thereof and having a bottom portion;

a plate lockup device provided in said gap and having a recess formed on a bottom thereof;

an origin position detecting switch with an actuating member, fixed on the bottom portion of said gap, for detecting that said plate lockup device, a position of which is adjustable at least in one of vertical and horizontal directions of the plate, is restored to an origin position thereof, said actuating member being engaged with the recess of said plate lockup device at the origin position that slides on said bottom portion of the gap; and informing means for informing that said plate lockup device is restored to the origin position on the basis of detection output from said origin position detecting switch.

* * * * *